United States Patent [19]

McInerney

[11] 4,067,684

[45] Jan. 10, 1978

[54] APPARATUS FOR CONTROLLING FUEL FLOW FLUID HEATER BURNER

[75] Inventor: Michael J. McInerney, Highland Park, Ill.

[73] Assignee: Vapor Corporation, Chicago, Ill.

[21] Appl. No.: 708,279

[22] Filed: July 23, 1976

[51] Int. Cl.[2] ..... F23N 1/02

[52] U.S. Cl. ..... 431/90; 236/14; 431/12

[58] Field of Search ..... 431/2, 12, 90, 278, 431/281, 285, 284; 236/14, 15 E; 137/7, 100, 94

[56] References Cited

U.S. PATENT DOCUMENTS

| | | | |
|---|---|---|---|
| 3,049,168 | 8/1962 | Litwinoff | 431/12 |
| 3,722,811 | 3/1973 | Osburn | 431/12 X |
| 3,734,675 | 5/1973 | Osburn | 431/12 |
| 3,795,476 | 3/1974 | Nelson | 431/90 |
| 3,894,834 | 7/1975 | Estes | 431/12 X |

*Primary Examiner*—Edward G. Favors
*Attorney, Agent, or Firm*—Francis J. Lidd

[57] ABSTRACT

Apparatus controlling a plurality of fuels of different heat contents to a fluid heater burner including valves for selectively connecting the fuels to the burner and pressure responsive fuel flow regulators responding to the combined fuel/air pressure at the fuel burner to provide a given level of output for the boiler.

5 Claims, 4 Drawing Figures

APPARATUS FOR CONTROLLING FUEL FLOW FLUID HEATER BURNER

This invention relates in general to control apparatus for a fluid heater or boiler producing hot water or steam, and more particularly to fuel controls responsive to the demands of the heater.

The present invention concerns the operation of a heater where it depends upon more than one fuel and when each fuel would have a different heat content. For example, it is well known to operate boilers on natural gas, sewer or digester gas, or oil. These fuels have different heat contents. In particular, fuels having low heat content present combustion difficulties, since changing from fuels of a high heat content to those having a low heat content is normally accomplished by changing the pressure of fuel gas delivered to the combustion chamber. The combined fuel air mixture for a high efficiency combustion system utilizing forced convection heat exchange between combustion gases from the burner flowing through and around heat exchanger surfaces would include primary, secondary and tertiary air together with a gaseous fuel all to be properly mixed in the combustion chamber. In order to supply a proper mixture, a minimum lower pressure for the fuel having the higher heat value must be established. This is due to the fact that combustion air requirements in a physically practical combustor/heat exchanger configuration which will successfully burn a given amount of fuel establishes a certain minimum static pressure in the combustion chamber or air box.

The present invention is particulary adaptable for use with boilers having an air box control, such as shown in U.S. Pat. No. 2,735,410. More specifically, the control mechanism illustrated in this patent increases or decreases the fuel flow and combustion air flow to the combustor in response to the demands of the system in which the boiler is used.

Heretofore, boiler control systems for handling fuels of different heat contents have been known, such as in U.S. Pat. Nos, 2,418,388; 3,105,540, and 3,159,345. However, these control systems have required the usage of multiple burners and complicated regulating systems in order to provide uninterrupted service during the changeover from the gas of one heat content to the gas of another heat content.

The present invention obviates the difficulties in heretofore known control systems for gases of varying heat contents by providing a system utilizing a single burner for handling the gases of different heat contents and by providing simplified controls dependent upon the requirements of the boiler. Essentially, only a single gas burner of a conventional type capable of handling fuels of various heat contents is employed in the boiler with the control system of the present invention, together with standard available components controlled by a unique arrangement. Accordingly, the present invention compensates automatically to provide a desired output of a heater or boiler fired by fuels of various heat contents.

It is therefore an object of the present invention to provide a new and improved control system for a fluid heater or boiler operable from fuels having different heat contents.

Another object of this invention is in the provision of a new and improved apparatus for conrolling fuel flow to a burner where fuels of different heat contents are utilized, which apparatus is simple and economical in construction and will provide accurate control operation for the boiler.

An additional object of this invention is to provide a control system which automatically adjusts the combined fuel air pressure at the combustion chamber to maintain fluid heater output, while utilizing fuels having substantial heat value variations.

Other objects, features and advantages of the invention will be apparent from the following detailed disclosure, taken in conjunction with the accompanying sheets of drawings, wherein like reference numerals refer to like parts, in which.

Figure 1:
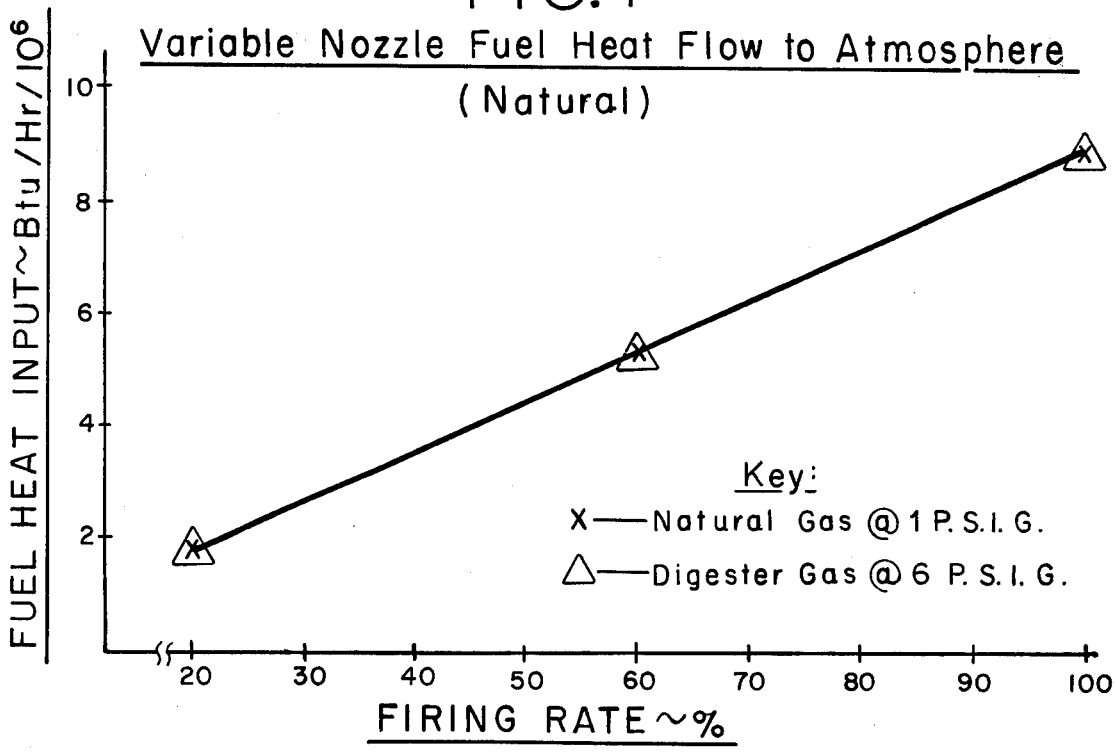
FIG. 1 is a graph illustrating "typical" heater output when firing two fuels at different pressures.

As the example shown in FIG. 1, if a burner is used for natural gas having a nominal heat value of 1000 BTU per cubic foot and digester gas having a nominal heat value of 500 BTU per cubic foot, in order to maintain heater capacity when changing from one fuel to another, the higher heat value gas must be supplied at approximately 1 pound per square inch (PSIG), and the lower heat value gas at approximately 6 PSIG and a zero PSIG combustion chamber pressure.

Figure 2:
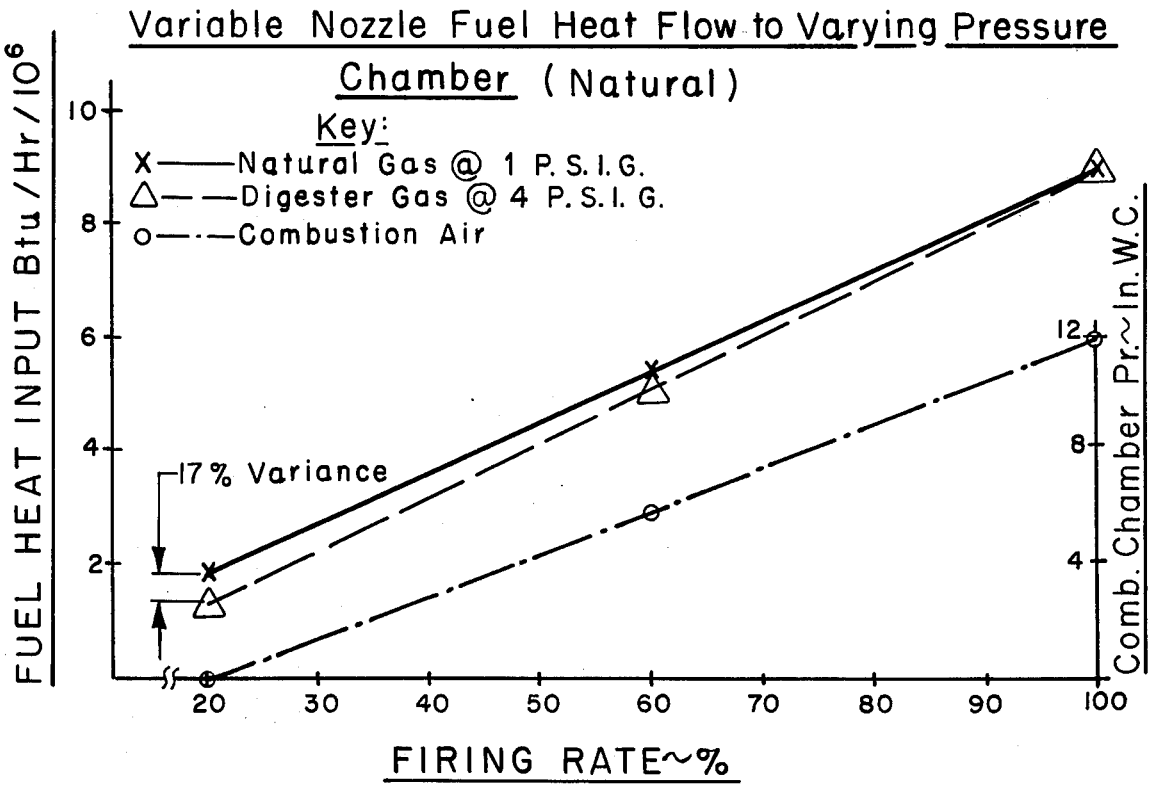
FIG. 2 is a graph illustrating heater output without the compensation system of the invention.

In the case of varying combustion chamber air pressure as illustrated in FIG. 2, where a minimum practical air pressure would be approximately 12 IN.$H_2$0, the high heat fuel pressure cannot be reduced below 1 PSIG without rendering the combustion system unstable and inoperative. Under these conditions, the pressure for a minimum low heat value fuel is approximately 4 PSIG. Primarily due to variations in gaseous flow characteristcs, this results in a reduction of heater capacity as shown in FIG. 2, since identical fuel input can be established at only one point in the modulating range.

Figure 3:
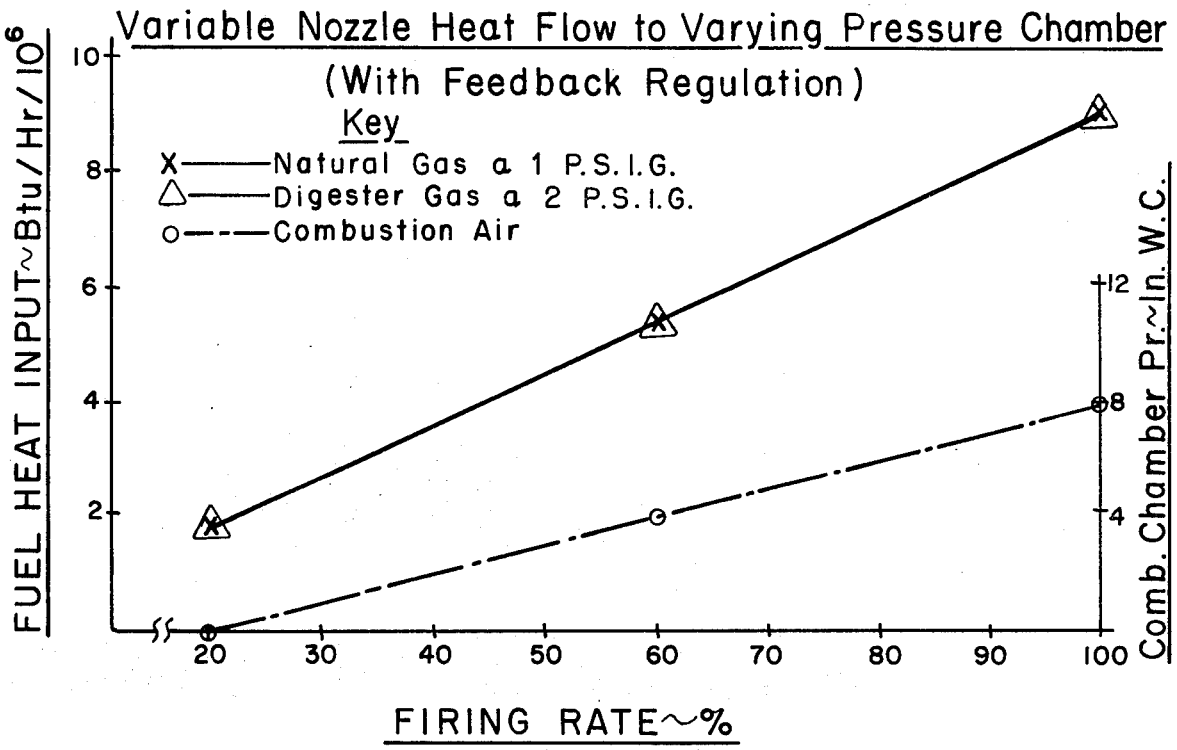
FIG. 3 is a graph illustrating heater output compensated according to the invention.

Use of the system disclosed here, however, eliminates this heater capacity reduction as shown in FIG. 3, where low heat value and high heat value fuel gases are utilized and provide essentially the same heater capacity over the entire heater range.

The minimum values of fuel in combustion air pressures, while only exemplary of forced draft combustion systems, indicated relative values which must be maintained for efficient satisfactory combustion.

A preferred embodiment of this invention is generally concerned with the control of a fluid heater on natural or digester gas. As indicated above, natural gas has a heat content of about 1000 BTU per cubic foot, while digester gas may only have a heat content of about 500 BTU per cubic foot. However, it should be recognized that the present invention is not limited to a combustion control system applicable to natural and digester gases and that the invention may well apply to any number of fuels having different heat contents.

Figure 4:
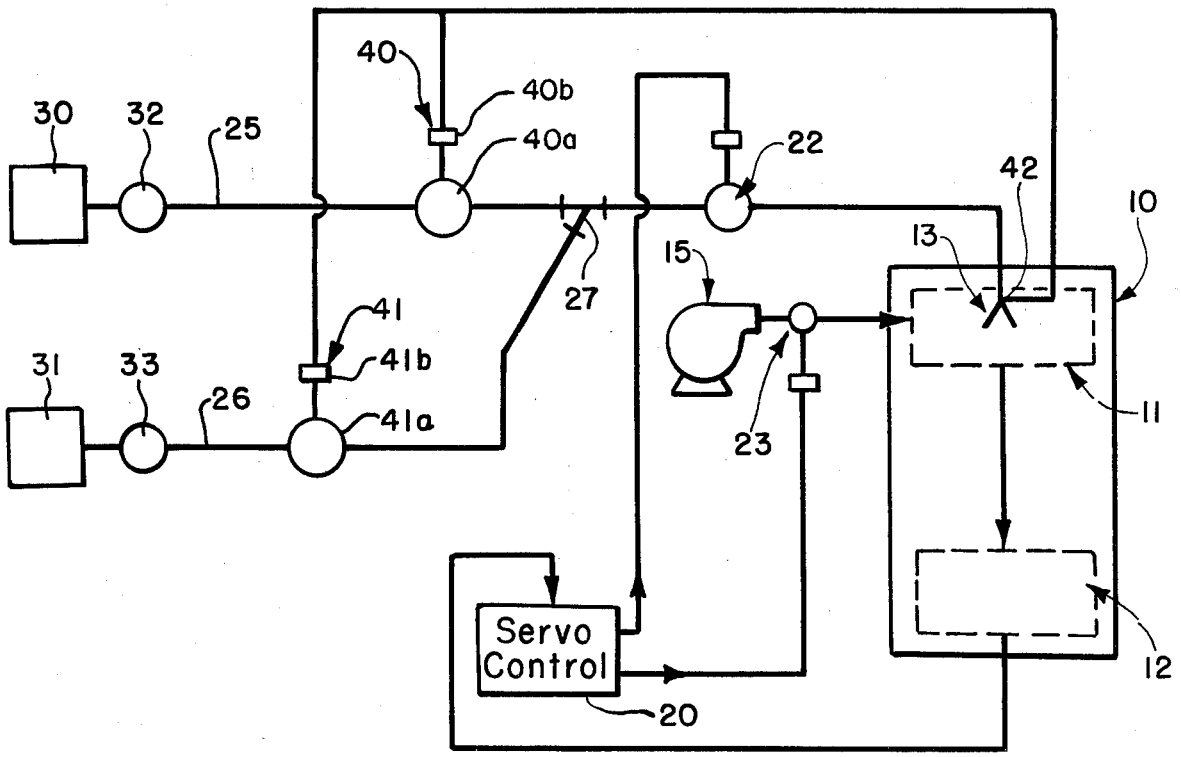
FIG. 4 is a system schematic diagram of a modulating liquid heater utilizing two fuels, and the compensation system of the invention.

Referring now to FIG. 4, a boiler 10 is schematically shown, which includes generally a combuster 11 and a coil assembly 12. The combustor 11 includes a burner 13 receiving a source of fuel from a main fuel line 14. A source of combustion air is delivered to the combustor 11 by a conventional blower 15. For example, this boiler may take the form shown in U.S. Pat. No. 2,735,410 and as sold by Vapor Corporation of Chicago, Ill.

The burner 13 is of the conventional type used for natural gas fuel and which is capable of handling digester gas. The gas flow to the burner and the combustion air flow to the combustor depends upon the demands of the boiler. A servo control 20 responds to the output of the boiler or the demands of the boiler and this servo control in turn controls a fuel flow control valve 22 and a combustion air control valve 23 to regulate the amount of fuel, combustion air and hence combined fuel/air pressure to the combustor. Accordingly, as the demand for more output of the boiler is required, an increase in the amount of fuel, combustion air and combined fuel/air pressure to the combustor will be made through the operation of the servo control 20. Likewise, a decrease in the demand for boiler output will decrease the fuel, air flow and combined fuel/air pressure to the combustor.

Either digestor gas may be delivered to the fuel flow control valve 22 and main fuel line 14 along the digester gas line 25 or natural gas may be fed to the fuel flow control valve and main fuel line from the natural gas line 26 through a T fitting 27. The digester is supplied to the line 25 from a source 30 while the natural gas is fed to the line 26 from a source 31. A shutoff valve 32 in the digester gas line 25 controls the feed of digester gas to the T fitting 27 while a shutoff valve 33 in the natural gas line 26 controls the feed of natural gas to the T fitting 27. Accordingly, depending upon whether the valve 32 or the valve 33 is open, digester gas or natural gas will be delivered to the fuel flow valve 22.

The apparatus according to the present invention for controlling the fuel flow to the flow control valve 22 includes a digester gas pressure responsive fuel flow regulator 40 and a natural gas pressure responsive fuel flow regulator 41 respectively located in the lines 25 and 26 and both of which respond to the pressure from the burner combined fuel/air pressure tap 42 at the fuel burner 13 in the combustor 11. As the pressure condition sensed at the tap 42 increases, the set point of the regulators 40 and 41 is changed to increase the openings of these valves. Each of the regulators 40 ad 41 includes valves **40*a* and 41*a* controlled by pressure responsive devices 40*b* and 41*b*, whereby an increase in pressure at the pressure responsive device will move the valve toward open position. While any suitable type of pressure responsive regulator may be provided, it is preferably that it be one of a straight-through flow design such as the Maxitrol regulator made by the Maxitrol Company. Accordingly, a variation in the pressure condition at the burner, which relates to the combination air box pressure as controlled by the valves 23 and the fuel flow pressure as controlled by the valve 22, increases or decreases the combined fuel/air pressure feedback which will effectively change the set point on the regulators 40 and 41**.

Where the digester gas source has a heat content of 500 BTU per cubic foot and the natural gas has a heat content of 1000 BTU per cubic foot, automatic correction for the heat content variation is accomplished by the present invention during manual or automatic changeover from one gas to the other where it is desired to hold the boiler output at a given level. For example, should natural gas be in use where valve 33 would be open and valve 32 would be closed, and a changeover be desired from natural gas to digester gas, closing of the valve 33 and opening of valve 32 will commence feeding of the lower heat content gas to the combustor. As the output of the boiler decreases due to the lower heat content, the servo control 20 will cause opening of the fuel flow control valve 22 and the blower air valve 23, thereby increasing the pressure at the burner 13. This increased pressure will feed back to the regulator 41 causing it to open and allow a greater flow of digester gas to the burner to compensate for the lower heat content. Accordingly, the output of the boiler will be maintained at the level desired. Similarly, a changeover from digester gas to natural gas would decrease the combined fuel/air pressure at the tap 42, and hence the feedback signal from the burner 13 and thereby close down the regulator 41 to decrease the flow of natural gas to the combustor.

From the foregoing, it can be appreciated the present invention provides a unique and simple control arrangement for handling fuels of different heat contents to maintain a given boiler output.

It will be understood that modifications and variations may be effected without departing from the scope of the novel concepts of the present invention, but it is understood that this application is to be limited only by the scope of the appended claims.

The invention is hereby claimed as follows:

1. In a fluid heater having a heat exchanger, a combustion chamber for producing heat for the heat exchanger, a fuel burner for the combustion chamber, means for producing combustion air for the combustion chamber, means for regulating fuel flow to the burner, means for regulating combustion air, and control means responsive to the output demands of the heat exchanger for controlling the fuel flow and combustion air regulating means to control the output of the heater, the improvement in means for supplying a plurality of fuels to said fuel flow regulating means and compensating for the heat content of said fuels, said fuel supplying means including a plurality of fuel sources selectably connectable to said fuel flow regulating means, pressure responsive fuel flow regulating means for each fuel source, each said pressure responsive fuel flow regulating means having a valve and a pressure responsive device for controlling operation of the valve, and means for feeding the combined fuel/air pressure at the fuel burner to each said pressure responsive device, whereby operation of each said valve responds to the combined fuel/air pressure at the fuel burner.

2. The improvement as defined in claim 1, wherein said fuel supplying means includes first and second fuel sources, and valve means for selectively connecting each of said fuel sources to said fuel flow regulating means.

3. The improvement as defined in claim 1, wherein each said pressure responsive device includes means for driving said valve therefor toward open position upon an increase in the pressure signal thereto.

4. In a fluid heater having a coil assembly, a combustor for producing hot gases for the coil assembly, said combustor having a fuel nozzle, means for regulating fuel flow to the nozzle, a blower for generating combustion air for the combustor, means for regulating for combustion air, and controls means responsive to the output demands of the heater for controlling the fuel flow regulating means and the combustion air regulating means to control the output of the heater, the improvement in means for supplying two fuels of different heat contents to said fuel flow regulating means and compensating for the heat content of said fuels controlling the fuel flows in response to the output demands of the heater, said fuel supplying means including means for selectably connecting one of said fuels to said fuel flow regulating means, pressure responsive fuel flow regulating means for each of said fuels, each said pressure responsive fuel flow regulating means having a valve and a pressure responsive device for controlling operation of the valve, and means connecting each said pressure responsive device to said fuel burner to feed back the combined fuel/air pressure to said devices whereby operation of each said valve responds to the output demands of the heater through the combined fuel/air pressure condition at the fuel burner.

5. The improvement as defined in claim 4, wherein each said pressure responsive device includes means for driving said valve therefor toward open position upon an increase in the pressure signal thereto.

* * * * *